US007963081B2

(12) United States Patent
Pierson et al.

(10) Patent No.: US 7,963,081 B2
(45) Date of Patent: Jun. 21, 2011

(54) ROOFING SYSTEM

(75) Inventors: John L. Pierson, Lakewood, OH (US); Michael D. Huber, Akron, OH (US); Thomas George Diamond, Cuyahoga Falls, OH (US)

(73) Assignee: Garland Industries, Inc., Cleveland, OH (US)

( * ) Notice: Subject to any disclaimer, the term of this patent is extended or adjusted under 35 U.S.C. 154(b) by 5 days.

(21) Appl. No.: 12/337,227

(22) Filed: Dec. 17, 2008

(65) Prior Publication Data

US 2010/0146898 A1 Jun. 17, 2010

(51) Int. Cl.
*E04C 3/00* (2006.01)
*E04B 7/00* (2006.01)
*E04B 1/62* (2006.01)

(52) U.S. Cl. ..... 52/461; 52/94; 52/394; 52/747.1; 52/395; 52/459; 52/463; 52/91.3

(58) Field of Classification Search ..... 52/94, 394, 52/395, 459, 463, 417, 747.1, 748.1, 90.1, 52/91.3, 309.4, 409, 478, 460, 461, 462, 52/464, 466, 469, 506.05, 520, 550, 551, 52/549

See application file for complete search history.

(56) References Cited

U.S. PATENT DOCUMENTS

| | | | | | |
|---|---|---|---|---|---|
| 1,148,647 | A | * | 8/1915 | Yetter | 52/549 |
| 1,692,401 | A | * | 11/1928 | Bard | 52/467 |
| 1,729,946 | A | * | 10/1929 | Kuehn | 52/478 |
| 2,242,266 | A | * | 5/1941 | Scales | 52/101 |
| 4,032,456 | A | * | 6/1977 | Berce | 210/474 |
| 4,128,984 | A | * | 12/1978 | Charbonneau et al. | 52/746.11 |
| 4,509,307 | A | * | 4/1985 | Beaudet | 52/309.4 |
| 4,619,100 | A | | 10/1986 | Emblin | |
| 4,741,132 | A | | 5/1988 | Emblin | |
| 4,864,781 | A | * | 9/1989 | Emblin | 52/58 |
| 5,242,736 | A | * | 9/1993 | Van Erden et al. | 428/137 |
| 5,644,882 | A | * | 7/1997 | Brown, Jr. | 52/462 |
| 2006/0032176 | A1 | | 2/2006 | Pierson et al. | |

* cited by examiner

*Primary Examiner* — Richard E Chilcot
*Assistant Examiner* — Mark R Wendell
(74) *Attorney, Agent, or Firm* — Fay Sharpe LLP; Brian E. Turung

(57) ABSTRACT

A roofing system formed of a plurality of support members secured to a load bearing roof deck. A plurality of roofing panels are positioned on the support members and are oriented to form overlapping joints between the panels. Sealant is positioned within the overlapping joints of the panels. A compression bar is positioned over the overlapping joints and is secured to the overlapping joints and support member by a fastener arrangement.

54 Claims, 3 Drawing Sheets

ROOFING SYSTEM

The present invention is directed to roofing systems, and more particularly to prefabricated roofing systems.

BACKGROUND OF THE INVENTION

Many types of roofing systems are used to cover a roof deck of a building. One type of roofing system is a prefabricated roofing system such as a metal roofing system. Typically, these metal roofing systems are formed from a plurality of metal panels. A number of prefabricated metal roofing systems have been developed. Such prefabricated metal roofing systems require substantial on-site construction and often do not make adequate provision for sealing around obstructions such as roof-mounted equipment and parapets. As a result, leakage can result at these points as thermal movement of the roofing system occurs. Furthermore, watertight integrity of such metal roofing systems is difficult to achieve and has led to various complicated and expensive systems such as roofing systems that use sealing membranes over the expanse of the roof surface. As a result, the roofing industry has long needed a prefabricated metal roofing system which can be quickly and easily erected with minimum labor and skill, which is reliably moisture-tight, and which is compatible with various building sizes, shapes and constructions.

One prefabricated type of metal roofing system disclosed in U.S. Pat. No. 4,619,100, which is incorporated herein by reference, was developed to address many of these past problems associated with metal roofing systems. The '100 patent discloses an improved preformed roof structure in which a series of rectangular sheet metal panels are joined along adjacent longitudinal edges at a sealed interlocking joint to form an elongate sheet metal skin. The sheet metal skin is secured in place on supports on the roof decking. Adjacent longitudinally extending sections of the sheet metal skin are joined at an overlapping joint which is secured by fasteners and further made moisture impervious by application of a suitable sealant. Insulation can also be provided between the sheet metal roof skin and the decking.

Although the metal roofing system disclosed in the '100 patent significantly overcomes many of the problems of past metal roofing systems, several problems still remain. The metal roofing system disclosed in the '100 patent used fasteners that were spaced about one and a quarter inch from one another to secure the panels to the support members that were secured to the deck of a roof on a building or other type of structure. The fasteners typically were metal screws applied under high torque conditions to properly secure the metal panels to the support members. When the mechanical fasteners were applied to the metal panels under high torque conditions, the metal panels, typically formed of light gauge metal sheet material, were compressed by the fastener. As a result of the localized compression on the metal panels, the sealant between the overlapped edges of the metal panels was forced to ooze or be displaced out from between the panels adjacent to the location of the applied fastener; however, the overlapped region that was spaced from the fastener exhibited less compression thereby resulting in less sealant oozing from or being displaced from between the overlapping panels. Consequently, uneven compression of the sealant occurred between the overlapping metal panels during the installation of the metal roofing system. Such uneven compression resulted in a less aesthetically pleasing appearance of the roofing system due to the oozing of the sealant from between the overlapping metal roofing panels. As a result, additional installation time had to be taken to remove the sealant that had oozed from between the overlapping metal roofing panels thereby increasing installation time and driving up the cost of installation. The uneven compression of the sealant also increased the incidence that the watertight seal between the metal panel could fail or be compromised, especially during summer months when the metal panels can significantly expand and contract due to the large temperature changes that can occur throughout the day. In order to combat this problem, the '100 patent recommended that the spacing of the mechanical fasteners be about one and a quarter inch from one another. The close spacing of the mechanical fasteners was extremely labor intensive, resulting in a significant added cost to the installation of the metal roofing system. The spacing requirement of the mechanical fastener also led to installation error wherein uniform spacing of the mechanical fasteners was periodically not maintained, thereby resulting in the potential for forming an improper seal between the overlapping metal panels.

Another installation problem associated with the roofing system of the '100 patent was that the high torquing of the mechanical fasteners, when securing the metal panels, also resulted in periodic over torquing of the mechanical fastener which could result in damage to the metal panels. When the mechanical fastener was overtorqued, the head of the fastener could penetrate or puncture through the light gauged metal panels and/or be sheared off, thereby a) resulting in improper fastening of the metal panels to the support members, b) resulting in damage to the metal panels, and/or c) having an adverse effect on the aesthetics of the roofing system.

Still another installation problem associated with the roofing system of the '100 patent was the occurrence of fish-mouthing of the overlapping panels during installation. During installation, the installer had to stand adjacent to the overlapping panels so that the installer could apply a mechanical fastener through the panels and connect the panels to the underlying support member. The weight of the installer commonly caused the light gauge metal, that was supporting the weight of the installer, to slightly deflect. This slight deflection caused the edge of the metal panel to rise and commonly separate, thereby forming a wide gap in the overlapping region of the panels, commonly referred to as fish-mouthing. This wide gap occasionally resulted in the seal between the panels being broken, thereby compromising the watertight seal between the overlapping panels after the mechanical fasteners were applied to the metal panels. The deflection of the metal panel also resulted in potential bending of the metal panel, which bending could potentially adversely affect the orientation of the roofing panels when forming a complete roofing system and/or adversely affect the aesthetics of the roofing system. The raising of the edge of the metal roofing panel due to the deflection of the roofing panel also increased the difficulty in properly applying the fasteners through the overlapping metal panels and/or properly connecting the overlapping metal panels to the underlying support member. This increased difficulty increased installation time and cost and also potentially resulted in the improper fastening of the metal panels to the support member, thereby adversely affecting the life and watertightness of the roofing system. In order to minimize the problems with deflecting panels, installers commonly laid wood boards on the metal panels to distribute the installer's weight over the metal panels, thereby reducing the amount of deflection of the metal panel. Although the use of wood boards was effective in minimizing much of the deflection of the metal panels during installation, the installer had to periodically stop installation of the metal panels in order to reposition the wood boards, thereby resulting in increased installation time and installation costs.

Yet another installation problem associated with the roofing system of the '100 patent was that the metal panels tended to form a crease during the installation of the metal panels. The problem with creasing was more of a problem when the metal panels were corrugated. When the corrugated metal panels were fastened to the underlaying support members, the corrugation at the edge of the metal panels became slightly flattened, resulting in a fanning effect of the metal panel during installation. To counter the fanning effect, the installer commonly repositioned the panel. Such repositioning, if not done properly, resulted in the metal panel forming a crease in the overlapping panel region. Such a crease could a) adversely affect the seal between the overlapping panels, b) could increase the difficulty in properly connecting the overlapping panels in the creased region to the underlaying support members, and/or c) could adversely affect to the aesthetics of the roofing system.

Still yet another installation problem associated with the roofing system of the '100 patent was that when a mechanical fastener was inserted on or close to a metal seam on the metal roofing panel, the insertion of the mechanical fastener periodically caused one section of the metal panel to slightly raise, thereby damaging or compromising the integrity of the metal seam. When the mechanical fastener was fully inserted, the section of the metal panel that had been lifted was at least partially moved back into position; however, if the metal section was raised too much during the insertion of the mechanical fastener, the seam in the metal panel would not properly reform, thereby potentially resulting in a compromise to the watertightness of the seal and/or adversely affecting the aesthetics of the roofing system.

In an effort to address several of the problems associated with the roofing system of the '100 patent, a compression bar was developed as disclosed in Unites States Patent Publication No. 2006-0032176, which is incorporated herein by reference. The compression bar solved several problems associated with a) undesired displacement of the sealant between overlapping roofing panel edges, b) uneven compression of the sealant between overlapping roofing panel edges, c) the need to closely space the mechanical fasteners, d) the need to highly torque the mechanical fasteners and damage to the roofing panels caused by overly torqued mechanical fasteners, e) the occurrence of fish-mouthing of the overlapping roofing panels during installation, and f) creasing of the roofing panels during the installation of the roofing system. Although several limitations of the roofing system disclosed in the '100 patent were addressed by the '176 patent application, the roofing system disclosed in the '176 patent application has several limitations, namely a) periodically caused undesired oozing of the sealant during installation of the roofing system which could adversely affect the aesthetics of the roofing system, b) sometimes required the use of multiple layers of sealant which was time consuming and labor intensive to apply and could result in the improper sealing of the roofing system, and c) the compression bar sometimes slipped out of position during installation resulting in improper compression by the compression bar, damage to the roofing panels and/or undesired aesthetics of the roofing system.

In view of the problems associated with the existing state of the art of metal roofing systems, there is a need for a metal roofing system that further decreases the time of installing the roofing system, further increases the ease of installing the roofing system, minimizes damage to the components of the roofing system during installation and, minimizes the occurrence of improper sealing of the roofing system components during installation.

SUMMARY OF THE INVENTION

The present invention is directed to prefabricated roofing systems and more particularly to prefabricated roofing systems. The roofing system of the present invention is designed to overcome the problems associated with prior prefabricated roofing systems. The invention will be described with particular reference to metal roofing systems that include a plurality of prefabricated roofing panels formed of a metal material; however, it will be appreciated that the invention is also applicable to prefabricated roofing systems that are formed from or include roofing panels made from other or additional materials such as, but not limited to, fiberglass, plastic materials, composite materials and/or the like. Prefabricated metal panels are commonly formed of carbon steel; however, it will be appreciated that one or more of the metal panels can be formed of other or additional materials such as, but not limited to, stainless steel, nickel alloys, copper, copper alloys, aluminum, aluminum alloys, titanium, titanium alloys, tin, tin alloys and/or the like. One or more of the roofing panels can be coated with a material (e.g., metal coating, polymer coating, etc.) that is used to extend the life of the roofing panels and/or be used to obtain the desired aesthetics of the roofing panels and/or improve the forming of the roofing system; however, this is not required. In one non-limiting design, one or more roofing panels are coated with a paint that is formulated to protect the roofing panel from degradation (e.g., corrosion, damage from UV light, damage from mold, etc.). In another and/or alternative non-limiting design, one or more roofing panels include a metallic coating that is formulated to protect the base metal of the roofing panel from corrosion (e.g., terne alloy coating, zinc coating, tin-zinc coating, etc.). In still another and/or alternative non-limiting design, one or more roofing panels is coated with a material that improves the heat dissipation and/or reflective properties of the roofing panel. In accordance with this non-limiting design, the coating material forms a light colored coating (e.g., white, beige, light blue, light yellow, etc.) on the roofing panel to facilitate in reducing the amount of heat absorption of the roofing system. The size and/or thickness of the prefabricated roofing panels is non-limiting and is typically selected for a particular application. Generally, the thickness of the roofing panel used on a standard building is at least about 0.02 inch and less than about 0.33 inch; however, it can be appreciated that other thicknesses can be used. The width of the roofing panels is generally at least about 12 inches and less than about 6 feet; however, it can be appreciated that other widths of the roofing panels can be used. The length of the roofing panels is also selected for a particular application. When the roofing panel is formed of a series of metal sections, a plurality of metal sections can be connected together to form the desired length of the roofing panel. Typically, the length of the roofing panel is at least about 3 feet and less than about 25 feet; however, it can be appreciated that other lengths can be used. When a plurality of pieces of metal material are connected together, the metal pieces are typically connected together in a manner to form a watertight seal; however, this is not required. In one nonlimiting configuration, a plurality of metal sections have a connection edge bent into a generally U-shaped or V-shaped bend and are then joined together by a cleat. Each cleat includes reversely bent lips which are inserted between the crimped or bent edges. A layer of sealant material such as, but not limited to, a cleat cement can be inserted in the crimped junction. The joined edge structure is then compressed up to a 150-ton press pressure to form a watertight seam between a plurality of metal sections that are used to form the roofing panel. As can be appreciated, many other connection arrangements can be used to connect together two or more metal sections of a roofing panel (e.g., welding, soldering, melting, adhesive sealant, rivets and sealant, etc.). The roofing panels can be formed into a continues roll to facilitate in the transport and/or the installation of the roofing panel; however, this is not required. In one non-limiting design, the roofing panel is a continuous coil of sheet material such as, but not limited to, 30-gauge galvanized or 0.24 inch aluminum sheet; however, it will be appreciated that other types of metal or non-metal roofing panel can be used. The galvanized metal or the aluminum, when used, may or may not be prepainted. The galvanized metal or the aluminum roofing panels are typically about three to four feet wide and have a length of about 10-15 feet; however, other widths and lengths can be used. The coil of roofing panel can be cut at a desired length during the installation on a deck of a building or precut prior to installation. The roofing panels can have a generally flat surface or have a non-planar or non-flat surface. When the roofing panels have a non-flat surface, the roofing panels can include, but are not limited to, one or more corrugations, ribs, etc. When the roofing panels include one or more corrugations, the roofing panels are typically run through a pattern machine to apply the corrugations to the roofing panels; however, this is not required. Typically the corrugations extend generally parallel to the opposed long length edges of the roofing panel; however, this is not required. When a non-flat profile is used, the non-flat profile can be used to stiffen and/or strengthen the resulting roofing panel; however, this is not required. The non-flat profile can also or alternatively be used to allow for expansion and contraction of the roofing panels without placing unnecessary stress on the structure which might otherwise cause the roofing panels to lift or cause the roofing panels to rear away from the support members, which undue stress and/or lifting of the roofing panels can cause damage to the integrity of the roofing system; however, this is not required. The non-flat profile can also or alternatively be used to at least partially form a desired drainage pattern on the roofing system; however, this is not required. The non-flat profile can also or alternatively be used to create the desired aesthetic appearance of a roofing system; however, this is not required. The surface of one or more roofing panels can have a smooth or non-smooth surface. When the roofing panel has a non-smooth surface, such surface can be used to reduce the slipperiness of the roofing system, create the desired aesthetics of the roofing system, etc.; however, this is not required.

In accordance with one non-limiting aspect of the present invention, the roofing system is designed to be used on one or more types of building structures. The roofing system can include a plurality of elongated support members disposed on the top of a deck of a building; however, this is not required. Several support members can be disposed along the peripheral edge of the roofing deck and several purlin support members are spaced in a generally parallel relationship with respect to each other; however, it can be appreciated that the orientation of one or more of the purlin support members can be in a non-parallel relationship, especially when the deck of the building has a nonstandard configuration. The support members, when used, typically extend upwardly from the deck of the building; however, this is not required. When the purlin support members are positioned in a generally parallel relationship to at least one edge of the deck of the building, the support members form a generally rectangular grid section on the deck of the building; however, this is not required. The generally rectangular grid sections can have extended lengths measured in a first direction generally parallel to one edge of deck and generally preselected widths measured in a second direction normal to the first direction of the extended lengths; however, this is not required. The purlin support members typically span across the entire deck of the building; however, this is not required. The support members can have a variety of shapes and can be formed of a variety of materials. In one non-limiting design, the support members are formed of a metal material. In another and/or alternative non-limiting design, a plurality of support members have a generally U-shaped cross-sectional configuration with opposite vertically upstanding legs; however, this is not required. One or more legs of the support members typically include a base portion or a base flange that is used to secure the support member to the deck of the building; however, this is not required. The support member, when in a generally U-shaped configuration, can include a bridge flange that extends between the two legs of the support member; however, this is not required. As can be appreciated, the support member is not required to have two legs (e.g., one leg, etc.). The bridge flange can be used to support the roofing panels that are positioned on the support members; however, this is not required. An insulation material can be positioned between the support members prior to inserting the roofing panels; however, this is not required. An insulation material can be positioned between the support members prior to inserting the roofing panels; however, this is not required. An insulation material can also or alternatively be positioned under bridge flange of the support member; however, this is not required. The insulation material, when used, can be used to reduce the amount of heat that is transmitted from the roof to the interior of the building on warm days and/or to reduce the amount of heat loss through the roofing system on colder days. The insulation can be, but is not limited to, a polyurethane foam that is blown or otherwise applied to the deck of the building. The installation can also or alternatively be formed of rigid blocks of polyurethane and/or polystyrene insulation that are placed on the deck of the building and between the support members. As can be appreciated, other or additional types of insulation can be used. The insulation, if used, can be supported by the continuous, load bearing roof deck; however, this is not required. The insulation typically does not extend above the top of the support members. When the insulation extends above the height of the support member, the insulation can interfere with the positioning of the roofing panels on the roofing system and/or interfere with the connection of the roofing panels to the support members. The insulation, when used, generally extends upwardly from the roof deck a height that is generally equal to the support member; however, it can be appreciated that the insulation can extend to a point that is less than the height of the support member. A plurality of prefabricated roofing panels are generally positioned on the support members so that the edges of the roofing panels at least partially overlap the support members; however, this is not required. When the support members are configured in a generally rectangular grid system on the deck of a building or other type of structure, the generally rectangular roofing panels can be used for positioning on the support members; however, this is not required. The roofing panels can be positioned on the support members such that the roofing panels are principally supported by the support members; however, this is not required. If such a support system is used for the roofing panels, the roofing panels can be generally freely disposed over the top surface of the insulation without bonding thereto; however, it can be appreciated that one or more of the roofing panels can be bonded or otherwise connected to the insulation. The edges of adjacently positioned panels are generally positioned so as to overlap with respect to one another at a region wherein the support member supports the edges of two or more panels. The edges of the overlapping panels are typically secured to the support members by a fastening arrangement; however, this is not required. In one non-limiting design, mechanical fasteners such as, but not limited to, screws, bolts, rivets, nails, clips, pins, etc. are used to secure one or more of the roofing panels to a support member. As can be appreciated, a roofing panel that is positioned at the edge of a deck of a building will typically not overlap another roofing panel. As such, a fastener arrangement can be used to secure the side edge of the roofing panel to such support member. In one non-limiting arrangement, the mechanical fasteners include screws such as, but not limited to, zinc-coated, self-tapping sheet metal screws. These screws are typically spaced apart a sufficient distance to obtain the desired fastening of the roofing panels to the support member. The screws are typically designed to penetrate the overlapping roofing panel edges and the support surface of the support member. As such, the screws can be used to secure the roofing panel edges together and to couple the roofing panels directly to the support member. In one non-limiting design, one or more of the fasteners are formed of a low heating conducting or insulating material. Such materials include, but are not limited to, plastics, ceramics, composite materials, carbon fiber composites, glass fiber composites, etc. The use of fasteners that are at least partially formed of low heat conducting or insulating materials can reduce the amount of heat transfer that occurs between the roofing panels and the roof deck, thereby increasing the insulating properties of the roofing system. As such, the energy rating of the roofing system can be improved. When standard metal fasteners are used, the metal fasteners act as a heat conduct between the roofing panels and the roofing deck by letting heat freely pass from the roof deck to the support member to the fastener and then to the roofing panels, and vice versa. The use of fasteners that are at least partially formed of low heat conducting or insulating materials can be used to reduce the amount of such heat transfer to the roofing panels and the roof deck. The insertion of a low heat conducting or insulating materials between the roofing panels and the support members can also or alternatively be used to reduce the amount of heat transfer between the roofing panels and the roof deck. Such low heat conducting or insulating materials can include, but are not limited to, adhesive, insulating tape, insulating mat, etc. Such materials, when used can be inserted onto the support member prior to the laying of the roofing panels on the support members, and/or be inserted onto the roofing panels prior to laying of the roofing panels on the support members. The top and/or base of the support member can include the low heat conducting or insulating materials and/or a section between the top and/or base of the support member can include the low heating conducting or insulating materials. The use of support members that are fully or partially formed of and/or include low heat conducting or insulating materials can also or alternatively be used to reduce the amount of heat transfer between the roofing panels and the roof deck. As can also be appreciated, the roofing panels can be fully or partially formed of and/or include low heat conducting or insulating materials that can also or alternatively be used to reduce the amount of heat transfer between the roofing panels and the roof deck. A sealant can be used to facilitate in forming a watertight seal between the roofing panels and the support member; however, this is not required. The sealant material can be positioned between the top surface of a support member and a roofing panel, positioned between the overlapping surface edges of two or more roofing panels and/or positioned on the top surface of the roofing panels. A sealant such as, but not limited to, "Mobile-lastic" commercially available from Elixir Industries of Gardenia, Calif. can be used; however, it will be appreciated that other or additional sealants can be used. When a sealant is used, the sealant is typically applied prior to applying the fasteners used to secure the one or more roofing panels to the support member; however, this is not required. The fasteners, when used, can apply a compressive force on the overlapping panel edges and the sealant between the overlapping edges and/or the support member and roofing panel to facilitate in forming a watertight seal; however, this is not required. A secondary sealant layer can be applied over the fastener arrangement and the overlapping edges of the roofing panels to facilitate in forming a watertight seal; however, this is not required. In one non-limiting arrangement, a sealant is applied over the fastener arrangement and the overlapping edges. In another and/or alternative non-limiting arrangement, a sealing membrane is applied over the fastener arrangement and the overlapping edges. As can be appreciated, other or additional sealing arrangements can be used.

In accordance with another and/or alternative aspect of the present invention, the roofing system can be designed so that it can be applied on a roof deck that has many different configurations and/or structures on the deck of the building; however, this is not required. In one non-limiting embodiment of the invention, the roofing system of the present invention can be used in conjunction with flashing to form a watertight seal with the edges of the deck of a building; however, this is not required. In one non-limiting arrangement, the edges and or sides of a building can be provided with flashing to seal the perimeter of the roofing system; however, this is not required. Flashing can be provided with a vertical edge section having an angular flange and a horizontal lip; however, other configurations of the flashing can be used. The angular flange can be located and positioned along a vertical wall of the building and designed to overlap the wall so that water is prevented from entering in an area between the roof deck and one or more roofing panels; however, this is not required. The edge of the roofing panel can be positioned to overlap the horizontal lip of the flashing and a sealant can be interposed therebetween to facilitate in forming a watertight seal; however, this is not required. A fastener arrangement can be used to secure the flashing and the edge of the roofing panel; however, this is not required. A fastener arrangement can also or alternatively be used to secure the roofing panel to a support member while another fastener arrangement can be used to hold an edge of the roofing panel to the flashing; however, this is not required. A sealant paint and/or other material can be applied over the fastener arrangement and/or the overlap region between the flashing and roofing panels to facilitate in the formation of a watertight seal; however, this is not required. As can be appreciated, other or additional connection arrangements can be used between the roofing panels and flashing. When there are structures extending from the deck of a building (e.g., air vent, etc.), flashing can be used to form a watertight seal between the roofing panels and such roofing structures; however, this is not required. The roofing system can be applied to a flat or sloped deck of a building. The roofing system can also be applied so as to have a pitch; however, this is not required. When a pitch is formed, the height of various support members can be selected to form the designed pitch of the roofing system; however, this is not required. If solid blocks of insulation are also or alternatively used, these blocks of insulation can be cut to conform with the desired pitch of the roofing system; however, this is not required. In one non-limiting installation method of the roofing system, the surface or deck of the building is initially cleaned and debris removed; however, this is not required. One or more of the air conditioning ducts, evaporative cooling units and/or similar units can be removed and/or set on pedestals so that flashing can be installed properly; however, this is not required. One or more of the vents, caps or other obstructions can be removed from the roof deck; however, this is not required. Once the roof surface is prepared, a grid plan is typically used to lay out the placement of the support members; however, this is not required. When a square or rectangular grid plan is being used, the support members extend longitudinally and may also extend transversely at the mid-point or where adjacent roofing panels are to overlap. One or more of the support members are secured to the roof deck. After the support members have been secured to the roof deck, pre-cut sheets of polystyrene or other insulation, when used, can be placed in one or more regions of the grid sections defined by the support members. The insulation typically does not exceed the top of the support members. Once the insulation is in place, the roofing panels, which are typically prefabricated and shipped in a coil, are unrolled or otherwise positioned over the grid sections of support members. Typically no type of bonding is placed between the top surface of the insulation and the bottom surface of the roofing panels so that the roofing panels are generally freely disposed over the insulation and with the outer edges of the roofing panels being registered in alignment with adjacent support members; however, bonding between the insulation and one or more roofing panels can be used in one or more regions of the roofing system. Each roofing panel, with its parallel outer edges, can be dimensioned to overlap the parallel support members that are disposed on either side of the blocks of insulation, when used; however, this is not required. One or more support members can be positioned along the peripheral edge of the roof deck while a plurality of support members can be laterally spaced across the roof deck away from the peripheral edge; however, this is not required. Typically, one of the roofing panels is initially attached to a support member located at the edge of the roof deck to ensure proper drainage; however, this initial connection is not required. A fastener arrangement is typically used to attach together the overlapping roofing panels. The fastener arrangement also can be used to connect the roofing panels to the support members at the perimeter of the roof deck. A sealant material is typically applied between the overlapping edges of the roofing panels and between the roofing panels and the support members located at the edge of the roof deck prior to applying the fastener arrangements; however, this is not required. The overlapping edges of the roofing panels are typically secured to each other and to support members by the fastener arrangements; however, this is not required. A particular roofing panel can be trimmed to accept roof vents, air units and other vertical obstructions; however, this is not required. Roof flashing is typically applied to seal the perimeter of the roofing system; however, this is not required. After the flashing, when used, has been secured, the roof surface should be cleaned of debris, tools, etc. An inspection should be made to check the seal of the overlapping edges of the roofing panels and the seams that connect the sections of the roofing panel together. This roofing system has many advantages. The weight per square foot of built-up roofing systems can range from approximately 1.5 to 7 times or more of that of the present roofing system. The thermal resistance (R-value) of the present roof can be substantially greater than that of a built-up roofing system, especially when insulation is used; however, this is not required. The roofing panels can be prepainted with a heat reflective coating to further improve the heat insulating properties of the roofing system; however, this is not required. A major part of the fabrication can be accomplished at the factory, thus reducing installation time; however, this is not required. The roofing panels and/or the support members can be precut to the desired length before being transported to the job site; however, this is not required. The roofing panel system has excellent weathering properties and wind uplift and water resistance, but is light-weight and can be quickly erected with minimum labor and skill. The roofing system can be adapted to buildings of almost any size, shape and construction method. The roofing system can be applied to new construction or can be retrofitted to existing buildings. Once the roofing system is installed, it typically requires little maintenance.

In accordance with still another and/or alternative aspect of the present invention, there is provided a compression bar that is used to improve the connection of overlapping edges of a plurality of roofing panels to an underlying support member and/or roof deck. In one non-limiting embodiment of the invention, the compression bar is designed to be laid at least partially on the surface of the uppermost roofing panel and at least partially over the location at which the overlapping edges of the roofing panels are to be connected to the underlying support member and/or roof deck. After the compression bar is positioned, a fastener arrangement is used to secure the compression bar to an underlying support member and/or roof deck and to causes the compression bar to be drawn downwardly toward the support member and/or roof deck, thereby causing the overlapping edges of the roofing panels that are entrapped between the compression bar and the support member and/or roof deck to be at least partially compressed together. Generally the compression bar has a width of at least about 0.365 inch to facilitate in positioning the compression bar in the desired location on the roofing panel. Typically the width of the compression bar is about 0.365-6 inches, and more typically about 0.5-4 inches, and even more typically about 0.625-2 inches; however, it can be appreciated that other widths can be used. The length of the compression bar is generally at least 6 inches, and more typically at least about 12 inches. The maximum length of the compression can vary depending on the roofing application. Generally, the compression bar is no more than about 15 feet; however, this is not required. The ratio of the length to width of the compression bar is generally at least about 3:1, and more typically at least about 10:1. The compression bar is generally formed of a durable material to resist damage during the installation of the roofing system and to also maintain its integrity throughout the life of the roofing system. The compression bar is also generally formed of a material that can transmit a compressive force along the longitudinal axis of the compression bar so as to obtain the desired amount of compression on the overlapping edges of the roofing panels during the installation of the roofing system. In one non-limiting design, the compression bar is formed of a metal, plastic, ceramic or composite material. In another and/or alternative non-limiting design, the material forming the compression bar has an average yield strength of at least about 50 MPa when the average thickness of the compression bar is about 0.0625 inch. As can be appreciated, when the compression bar is thicker than about 0.0625 inch, materials having a yield strength of less than about 50 MPa can be used. In one non-limiting design, the average thickness of the compression bar is about 0.0625-1 inch, more typically about 0.0625-0.5 inch, and still more typically about 0.0625-0.25 inch; however, other thicknesses can be used. The average yield strength of the material used to form the compression bar is about 50-2000 MPa, and typically about 100-1500 MPa; however, other materials having different yield strengths can be used. In another and/or alternative non-limiting embodiment of the invention, the compression bar improves the uniformity of compression of the overlapping edges of the roofing panels to the support member during the installation of the roofing system, thereby 1) limiting the amount of fish-mouthing of overlapping panels during installation, 2) obtaining improved and more uniform compression of the sealant that is located between two or more overlapping roofing panel edges and/or between one or more roofing panels and the underlying support member thereby reducing the amount of sealant clean-up and providing a better and more uniform seal, 3) reducing the incidence of a seam that connects two sections of a roofing panel together from separating, which can result in compromising the watertightness of the roofing panel and/or reduce the aesthetics of the roofing panel, and or 4) reducing the incidence of the roofing panels creasing during installation. In still another and/or alternative non-limiting embodiment of the invention, the compression bar can be used as a support by an installer to enable the installer to place his/her weight on the compression bar during installation thereby eliminating the need for the use of wood boards or other types of temporary support arrangements used to support the weight of the installer during the installation of the roofing system.

In accordance with yet another and/or alternative aspect of the present invention, there is provided a compression bar that includes a plurality of markings or holes that are designed such that a portion of a fastener arrangement can pass through the holes and connect the overlapping edges of the roofing panels to the underlying support member. As such, the markings or holes in the compression bar can be used to function as a template for the fastener arrangements; however, this is not required. The markings or holes in the compression bar can be positioned so as to have the desired spacing for proper installation of the roofing system, and/or guide a fastener arrangement in the correct location into the overlapping roofing panels; however, this is not required. In one non-limiting design, the compression bar can be designed such that the edge of the compression bar is aligned with the edge of overlapping roofing panels, and after such positioning of the compression bar, the markings or holes in the compression bar indicate the desired location that the fastener arrangements are to be inserted through the overlapping edges of the roofing panels to be properly connected to the underlying support member. When holes are used in the compression bar, the holes in the compression bar are typically sized so that the fastener arrangement also connects the compression bar to the support member and/or roof deck and causes the compression bar to move toward the support member thereby causing compression of the overlapping roofing panel edges between the compression bar and the underlying support member and/or roof deck. When one or more markings are used in the compression bar, the markings include, but are not limited to, colored markings, partially pre-drilled openings, partially stamped openings, indents, etc.; however, it can be appreciated that the markers can have other or additional forms. In another and/or alternative non-limiting embodiment of the invention, the use of the compression bar can reduce or prevent fish-mouthing of overlapping panels during installation, the incidence of a seam that connects two sections of a roofing panel together from separating, and or the incidence of the roofing panels creasing during installation. When the fastener arrangement is in the form of a screw, the compression bar limits or prevents damage to the roofing panels due the overtorquing of the screw, which overtorquing on prior art roofing systems could result in the tearing of the roofing panel. The use of the compression bar can also or alternatively limit or prevent such damage to the roofing panels since the head of the screw typically does not pass fully through the compression bar and the compressive forces being applied on the compression bar are at least partially transmitted along the length of the compression bar thereby reducing highly localized forces on the roofing panels that have in the past caused damage to the roofing panels. In still yet another and/or alternative non-limiting embodiment of the invention, the use of markers and/or holes in the compression bar can reduce or prevent damage to the fastener arrangement. The markers and/or holes can be designed to reduce or eliminate the amount of material of the compression bar the fastener arrangement has to penetrate before connecting one or more roofing panels to the underlying support member and/or roof deck. When the fastener arrangement is in the form of a screw, the head of the screw could shear when the screw has to penetrate the complete compression bar and one or more roofing panels. In a further and/or alternative non-limiting embodiment of the invention, the markers or holes in the compression bar are generally spaced apart at least about 0.5 inch and more typically at least about 1 inch, and even more typically about 1.5-4 inches; however, other hole spacings can be used. The use of the compression bar enables the spacing of the fastener arrangements to be greater than about 1.25 inch; however, this is not required. In prior art roofing systems, the spacing of the fasteners had to be small so that proper compression of the seal between overlapping roofing panels occurred. As such, the spacing of the fasteners was typically about 1-1.25 inches apart thereby making the installation of prior art roofing system very labor intensive. It is believed that the transmission of compressive forces at least partially along the longitudinal length of the compression bar is at least one factor that allows for the increased spacing of the fastener arrangement. As such, a lesser number of fasteners are required to properly install the roofing system of the present invention, thereby saving time, materials, material costs and labor costs to install such roofing system.

In accordance with still yet another and/or alternative aspect of the present invention, there is provided a compression bar that forms a more uniform seal between two or more roofing panels. The transmission of forces along the compression bar is believed to form a more uniform seal between overlapping roofing panels and/or between one or more roofing panels and a support member and/or roof deck, especially when a sealant is used.

In accordance with a further and/or alternative aspect of the present invention, there is provided a compression bar that can be used with a sealant, paint, metal coating and/or other type of protective coating. A sealant, paint, metal coating and/or other type of protective coating can be applied to the compression bar to provide protection to the compression bar and/or to enhance the aesthetics of the roofing system; however, it can be appreciated that the protective coating can have other or additional uses and/or functions. The protective coating can be applied prior to the installation of the roofing system and/or after the compression bar has been secured to the roofing system. When a protective coating is used, a protective coating is typically applied after the compression bar has been connected to the roofing system by the fastener arrangement. Typically, the protective coating is applied over both the compression bar and the fastener arrangements; however, this is not required.

In accordance with still a further and/or alternative aspect of the present invention, there is provided a compression bar that includes a lip at least partially along the longitudinal length of at least the edge of the compression bar. The lip can have a variety of shapes (e.g., arcuate, straight, etc.). The lip can be designed to extend downwardly from the upper surface of the compression bar. In one non-limiting design, the upper surface of the compression bar has a generally flat surface and the lip slopes generally linearly from the upper flat surface of the compression bar. As can be appreciated, the top surface of the compression bar can have a non-flat surface profile and slope non-linearly from the upper flat surface of the compression bar. Linearly sloped angles generally are about 2-175° which are measured from the generally flat top surface plane of the compression bar, and typically about 10-120°, more typically about 20-90°, and even more typically about 30-75°. When the upper surface of the compression bar is not generally flat, the linearly sloped angle is measured from the generally flat top surface of the roofing panels when the compression bar is placed on the top surface of the roofing panels just prior to the compression bar being connected to the roofing panels. The width of the lip generally constitutes less than 50% of the total width of the compression bar, typically about 5-25% of the total width of the compression bar, and more typically about 10-20% of the total width of the compression bar; however, other widths can be used. In another and/or alternative non-limiting design, the bottom end of the lip extends below the bottom surface of the compression bar; however, this is not required. Generally, the bottom end of the lip extends below the bottom surface of the compression bar a distance of about 5-400% of the average thickness of the compression bar, typically about 25-250% of the average thickness of the compression bar, more typically about 50-175% of the average thickness of the compression bar, and even more typically about 75-125% of the average thickness of the compression bar; however, it will be appreciated that other distances that the lower end of the lip extends below the bottom surface of the compression bar can be used. The lip generally has the same thickness as the other portions of the compression bar; however, this is not required. The lip can have a variety of functions and/or uses such as, but not limited to, 1) overlapping and at least partially covering an edge of one or more roofing panels, 2) facilitating in sealing two of more overlapping roofing panels, 3) facilitating in maintaining a sealant between two roofing panels, 4) at least partially protecting a sealant between two roofing panels, and or 5) functioning as a guide for the placement of the compression bar during installation of the roofing system. As can be appreciated, the lip can have other and/or additional functions and/or uses. When the lip at least partially overlaps and/or covers an edge of one or more roofing panels, the lip can improve the aesthetics of the roofing system, improve drainage patterns on the roofing system and/or at least partially cover rough and/or uneven edges of one or more roofing panels; however, the lip can have other or additional functions and/or uses. The lip can facilitate in sealing two or more overlapping roofing panels by directing liquid flow away from the sealed or unsealed region between two or more overlapping roofing panels; however, this is not required. The lip can facilitate in maintaining a sealant between two roofing panels by acting as a full or partial barrier to the sealant between two roofing panels; however, this is not required. As the roofing panels are compressed together during installation, the lip can at least partially prevent the sealant from flowing from between the roofing panels, thereby preserving, maintaining and/or improving the seal between the roofing panels; however, this is not required. The preventing of the flow of sealant out from between the overlapping roofing panels can also improves the aesthetics of the roofing system; however, this is not required. The lip on the compression bar can also be used to at least partially protect the sealant from the environment (e.g., dirt, grease, pollution, water, ice, snow, etc.) and thereby increase the life of the sealant and the seal between the overlapping roofing panels; however, this is not required. The lip on the compression bar can at least partially function as a guide or template for positioning the compression bar over overlapping roofing panels during the installation of the roofing system; however, this is not required. The lip can be positioned to at least partially overlie the overlapping roofing panels thereby facilitating in the positioning of the compression bar on the roofing panels; however, this is not required.

In accordance with still yet a further and/or alternative aspect of the present invention, there is provided a compression bar that includes a non-smooth bottom. The non-smooth bottom of the compression bar facilitates in gripping the bottom of the compression bar, during installation of the compression bar to the roofing system, to 1) the sealant that is located between the roofing panels and the compression bar, and/or 2) the one or more roofing panels that are positioned beneath the compression bar when the compression bar is installed on the roofing system. The non-smooth bottom of the compression bar can also or alternatively facilitate in increasing the surface area of the bottom surface of the compression bar to thereby increase the contact surface of the bottom of the compression bar with any sealant that is positioned between the compression bar and one or more roofing panels. As can be appreciated, the non-smooth bottom can provide other or addition advantages to the compression bar. The non-smooth surface can form all or a portion of the bottom surface of the compression bar. The non-smooth surface can be in the form of a variety of features (e.g., teeth, grooves, bumps, ribs, slots, notches, channels, corrugations, etc.). In one non-limiting configuration, the bottom surface of the compression bar includes a plurality of slots or ribs along the longitudinal length of the compression bar. These slots or ribs are generally positioned parallel to one another; however, this is not required. Generally the bottom surface includes a plurality of such slots or ribs; however, this is not required. The top surface of the compression bar can include one or more channels or grooves that can be used to facilitate in the channeling of fluid off of the roofing system; however, this is not required.

In accordance with still yet a further and/or alternative aspect of the present invention, there is provided a sealant in the form of a tape sealant. The tape sealant can be used to at least partially form a water-tight seal a) between two overlapping roofing panel edges, b) between the support member and at least one roofing panel, c) between the compression bar and at least one roofing panel, and/or d) between the top of the fasteners and the top surface of the compression bar. In one non-limiting arrangement, the tape of sealant is designed so that a portion of the sealant can be positioned between two overlapping roofing panel edges and another portion of the tape of sealant can be simultaneously positioned between the compression bar and at least one roofing panel. In such an arrangement, the tape of sealant is folded so as to have a C-shape or U-shape configuration so that it can be both inserted between two overlapping roofing panel edges and between the compression bar and at least one roofing panel. In such a arrangement, a single piece of sealant tape can be used to form a watertight seal between two overlapping roofing panel edges and between the compression bar and at least one roofing panel. As can be appreciated, the tape of sealant can be designed so that a portion of the sealant can be positioned between two overlapping roofing panel edges and another portion of the tape of sealant can be simultaneously positioned between a support member and at least one roofing panel. As can also be appreciated, two pieces of sealant tape can be used wherein one piece of sealant tape can be designed so that a portion of the sealant can be positioned between two overlapping roofing panel edges and another portion of the tape of sealant can be simultaneously positioned between a support member and at least one roofing panel, and another piece of sealant tape can be designed to be positioned between two overlapping roofing panel edges and another portion of the tape of sealant can be simultaneously positioned between the compression bar and at least one roofing panel. In such an arrangement, two pieces of sealant tape can be used to form a watertight seal between two overlapping roofing panel edges and between the compression bar and at least one roofing panel and to also form a watertight seal between two overlapping roofing panel edges and between the support member and at least one roofing panel. The length and width of the sealant can vary depending on the application. One or both sides of the sealant tape can have adhesive properties. In another non-limiting arrangement, the sealant tape is a butyl sealant tape. It has been found that butyl sealant tape has desirable characteristics when used in the roofing system of the present invention. Butyl sealant tape has been found to form a durable and long lasting water-tight seal between the different materials that are used to form the roofing system of the present invention. In addition, butyl sealant tape is deformable when subjected to pressure, but does not continue to deform when no further pressure increases are exerted on the butyl sealant tape. As such, when the fasteners are used to secure the compression bar to the roofing panels and compress the roofing panels together, the pressure applied by the compression bar causes the butyl sealant tape to deform and fill in spaces between various roofing system components so as to form a water-tight seal between such components. However, once the compression bar is secured to the roofing panels and there is no further tightening of the compression bar to the roofing panels, the deformation of the butyl sealant tape stop so as to avoid unwanted oozing of the sealant that commonly occurred when using other types of prior art sealants. In one specific non-limiting example, the butyl sealant tape is a tape that includes or is polyisobutylene (butyl Tape). Such a tape is a flexible tape that has as a thickness of about 0.02-0.4 inches, typically about 0.05-0.2 inch, and more typically about 0.06-0.15 inch, and has a width of about 0.5-5 wide, typically about 1-4 inches wide, and more typically about 1-3 inches wide.

In summary, the use of a compression bar can result in simplifying the installation of the roofing system and increasing the quality of the roofing system by 1) functioning as a template for easy and more uniform and correct positioning of the fastener arrangements on the roofing system, 2) reducing the incidence of damage to the roofing panels and/or fastener arrangements when connecting the fastener arrangements to the roofing panels, 3) applying a more uniform compressive force to the roofing panels to form an improved seal between the overlapping edges of the roofing panels, 4) reducing the time needed to install the roofing system, 5) providing a support surface for an installer of the roofing system, 6) reducing the incidence of creasing or other types of damage to the roofing panels during installation, 7) reducing the incidence of seam compromise between sections of a roofing panel during installation, 8) at least partially covering one or more edges of a roofing panel, 9) facilitating in sealing two of more overlapping roofing panels, 10) facilitating in maintaining a sealant between two roofing panels, 11) at least partially protecting a sealant between two roofing panels, 12) improving the aesthetics of the roofing system, and or 13) functioning as a guide for the placement of the compression bar during installation of the roofing system. The non-smooth bottom surface of the compression bar can be used to maintain the position of the compression bar on the roofing panels when securing the compression bar to the roofing panels. The use of sealant tape can result in simplifying the installation of the roofing system and increasing the quality of the roofing system by 1) creating multiple water-tight seals, 2) reducing the time needed to install the roofing system, 3) facilitating in sealing two of more overlapping roofing panels, 4) facilitating in forming a sealing between the compression bar and one or more roofing panels, 5) facilitating in forming a sealing between the support member and one or more roofing panels, and/or 6) improving the aesthetics of the roofing system.

One object of the present invention is the provision of a roofing system that is easy to install.

Another and/or alternative object of the present invention is the provision of a roofing system that requires less time to install.

Still another and/or alternative object of the present invention is the provision of a roofing system that reduces installation errors.

Yet another and/or alternative object of the present invention is the provision of a roofing system that reduces damage to the roofing panels during installation.

Still yet another and/or alternative object of the present invention is the provision of a roofing system that forms a more uniform compressive seal between a plurality of overlapping roofing panels.

A further and/or alternative object of the present invention is the provision of a roofing system that includes a compression bar that at least partially functions as a template for easy and more uniform and correct positioning of the fastener arrangements on the roofing system.

Still a further and/or alternative object of the present invention is the provision of a roofing system that includes a compression bar that at least partially reduces the incidence of damage to the roofing panels when connecting the fastener arrangements to the roofing panels.

Yet a further and/or alternative object of the present invention is the provision of a roofing system that includes a compression bar that at least partially applies a more uniform compressive force to the roofing panels to form an improved seal between the overlapping edges of the roofing panels.

Still yet a further and or alternative object of the present invention is the provision of a roofing system that includes a compression bar that at least partially provides a support surface for an installer of the roofing system.

Another and/or alternative object of the present invention is the provision of a roofing system that includes a compression bar that at least partially reduces the incidence of creasing or other types of damage to the roofing panels during installation.

Still another and/or alternative object of the present invention is the provision of a roofing system that includes a compression bar that at least partially reduces the incidence of seam compromise between sections of a roofing panel during installation.

Yet another and/or alternative object of the present invention is the provision of a roofing system that includes a compression bar that at least partially covers one or more edges of a roofing panel.

Still yet another and/or alternative object of the present invention is the provision of a roofing system that includes a compression bar that at least partially facilitates in sealing two or more overlapping roofing panels.

A further and/or alternative object of the present invention is the provision of a roofing system that includes a compression bar that at least partially facilitates in maintaining a sealant between two roofing panels.

Still a further and/or alternative object of the present invention is the provision of a roofing system that includes a compression bar that at least partially protects a sealant between two roofing panels.

Yet a further and/or alternative object of the present invention is the provision of a roofing system that includes a compression bar that at least partially improves the aesthetics of the roofing system.

Still yet a further and/or alternative object of the present invention is the provision of a roofing system that includes a compression bar that at least partially functions as a guide for the placement of the compression bar during installation of the roofing system.

Another and/or alternative object of the present invention is the provision of a roofing system that includes a compression bar that has a non-smooth surface that facilitates in the placement of the compression bar on one or more roofing panels and/or the maintaining of the compression of the compression bar on one or more roofing panels during the installation of the roofing system.

Still another and/or alternative object of the present invention is the provision of a roofing system that includes the use of a tape sealant to facilitate in the formation or one or more water-tight seals between various components of the roofing system.

These and other objects and advantages will become apparent from the following description taken together with the accompanying drawing.

BRIEF DESCRIPTION OF THE DRAWINGS

Reference may now be made to the drawings, which illustrate at least one embodiment that the invention may take in physical form and in certain parts and arrangements of parts wherein.

NON-LIMITING EMBODIMENTS OF THE INVENTION

Figure 1:
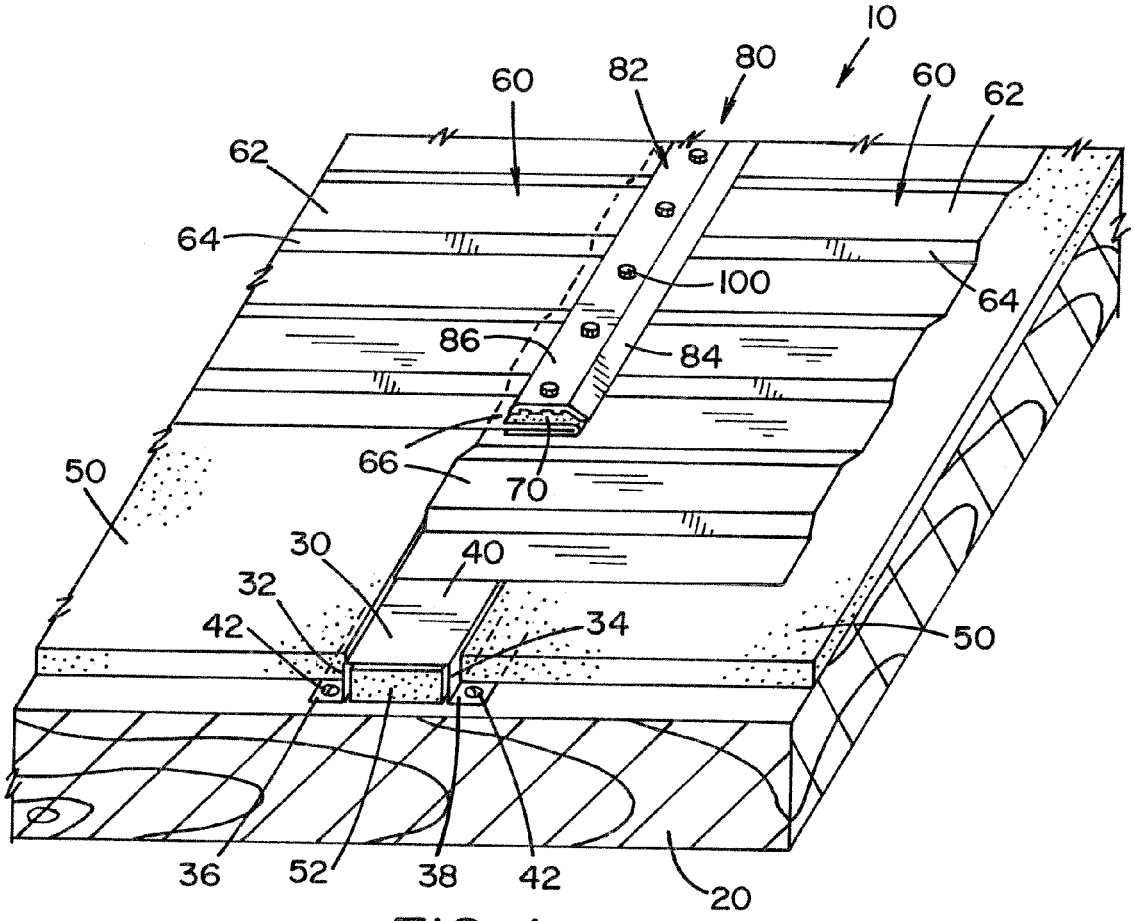
FIG. 1 is a perspective view of a representative of a representative section of a roofing system in accordance with the present invention.
Figure 2:
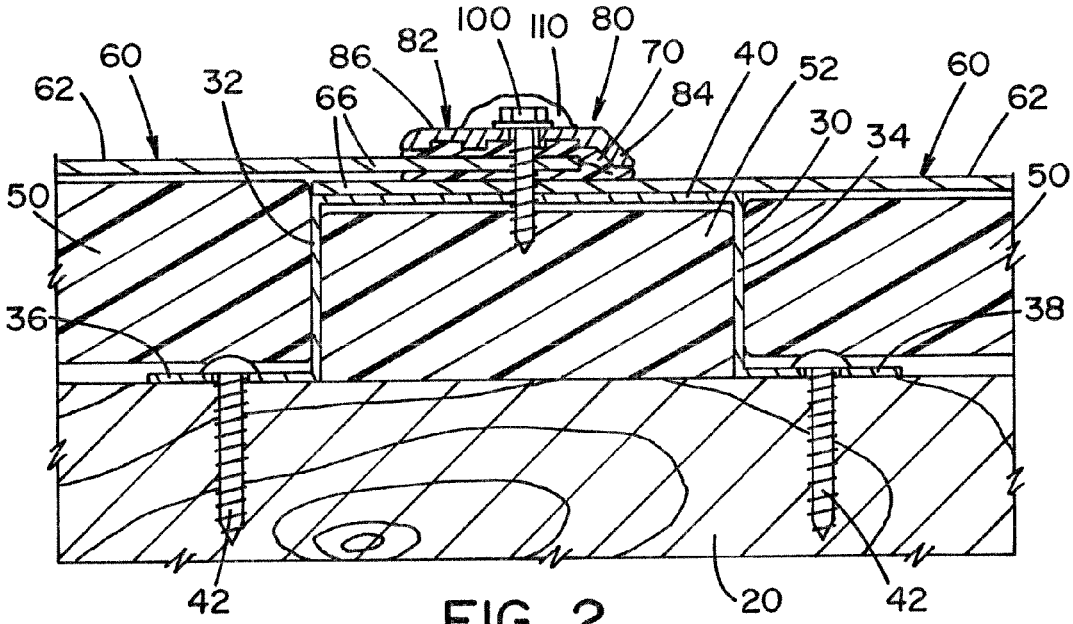
FIG. 2 is a cross-sectional view of the roofing system of FIG. 1.
Figure 3:
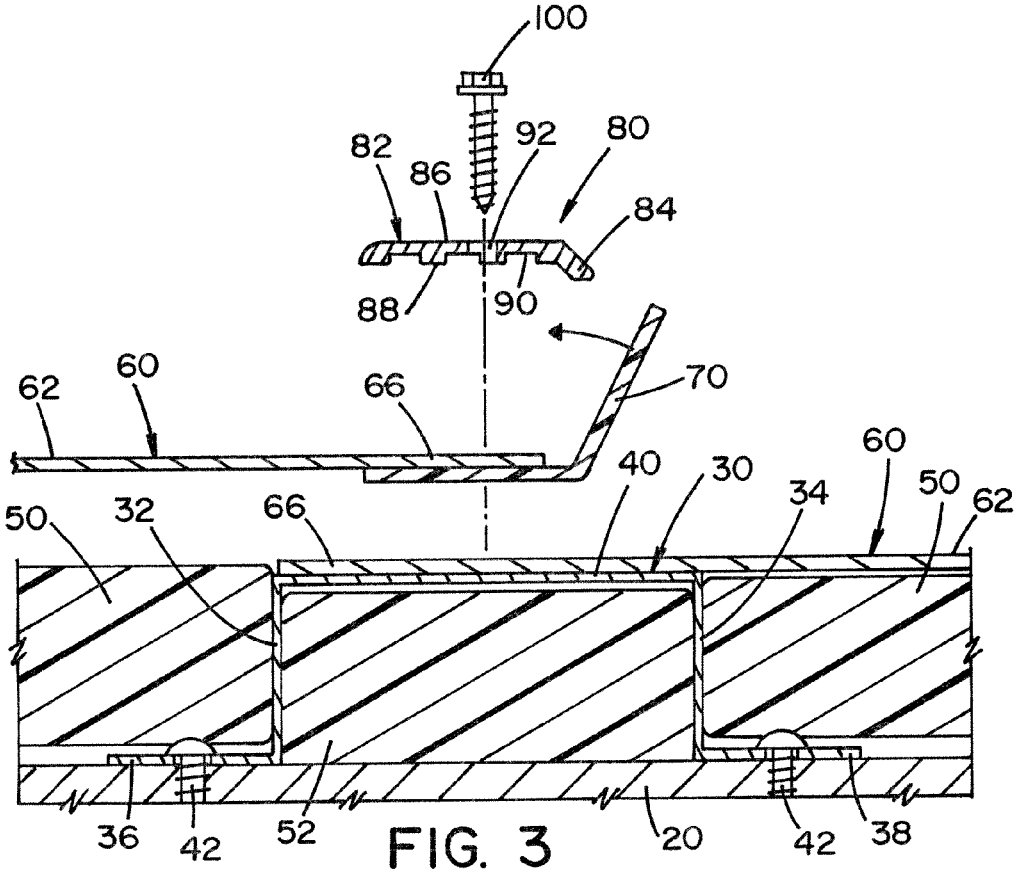
FIG. 3 is a partially exploded view of FIG. 2 illustrating the application of a sealant tape in accordance with the present invention.

Referring now to the drawings wherein the showings are for the purpose of illustrating non-limiting embodiments of the invention only and not for the purpose of limiting same, FIGS. 1-3 illustrate one non-limiting embodiment of the roofing system of the present invention. The roofing system, generally designated 10, is shown mounted on a roof deck 20 of a building, which may be of any construction.

As shown in FIGS. 1 and 2, the roofing system 10 comprises a supporting frame structure including a plurality of elongated support members 30 disposed on the top of roof deck 20. The support members can be made of a variety of materials. One such material that can be used for one or more of the support members is carbon steel, aluminum, plastic; however, other or additional materials can be used. As can be appreciated, a plurality of support members 30 are positioned on the roof deck. Several support members are can be disposed along the peripheral edge of a roof deck and several other support members can be spaced in various relationships to one another (e.g., parallel relationship, etc.). In one non-limiting arrangement, the support members are spaced from one another to form a rectangular grid system, not shown, on the roof deck. As can be appreciated, the support members can be arranged in a variety of other or additional configurations on the roof deck. The rectangular grid sections, when formed, typically have extended lengths measured in a first direction parallel to one edge of the roof deck and preselected widths measured in a second direction normal to the first direction of the extended lengths. Typically, the support members 30 that are positioned parallel from one another and are parallel to the longitudinal length of the roofing panels are spaced about 1-15 feet from each other, and typically about 10-14 feet from one another; however, other spacing can be used. Transversely spaced support members can be used for larger roofing decks. These transversely spaced support members can be spaced about 1-100 feet from one another, and typically about 20-80 feet from one another; however, other spacing can be used. The support members can be designed to span across the entire roof deck; however, this is not required.

The support members have a generally U-shaped cross-sectional configuration with opposite vertically upstanding legs 32 and 34 and a mount flange 36, 38 on each of the legs. As can be appreciated, the support flange can have other cross-section shapes (e.g. C-shaped, D-shaped, S-shaped, Z-shaped, etc.) and or less than two legs. As can also or additionally be appreciated, only one of the legs can include the mount flange. As can further be appreciated, the mount flange can extend the full or partial longitudinal length of the support member. The mount flanges 36, 38 are used to secured the support member to roof deck 20 by a fastener 42. Typically, fastener 42 is a screw, nail, rivet, etc. that is used to secure the support member to the roof deck. As shown in FIGS. 2 and 3, fastener 42 is a screw. An intermediate support flange 40 extends between legs 32 and 34 and supports. The intermediate support is designed to at least partially support one or more roofing panels 60 at least partially above the roof deck. The height of legs 32, 34 is typically about 0.25-6 inches, and typically about 0.5-1.5 inches; however, other heights can be used. The height of the legs on different support members can be the same or different. The use of support members having different height legs can be used to create a pitch of the roofing system on the roof deck; however, this is not required. The width of intermediate support flange 40 is typically about 0.5-8 inches, and more typically about 1-3 inches; however, other widths can be used. The width of mount flanges 36, 38 is typically about 0.25-3 inches, and more typically about 0.5-1.5 inches; however, other widths can be used.

Rigid blocks of insulation 50 (e.g., polyurethane, polystyrene, etc.) are placed within each of the grid sections defined by the intersection of the longitudinal and transverse support members. As can be appreciated, many types and/or shapes of insulation can be used. The blocks of insulation, when used, are typically supported below by the continuous, load bearing roof deck 20. One or more blocks of insulation can be secured to the roof deck; however, this is not required. When one or more blocks of insulation are secured to the roof deck, a variety of mechanisms can be used such as, but not limited to, an adhesive, nail, etc. As shown in FIGS. 1-3, the blocks of insulation have a thickness such that the top of the blocks of insulation is level or nearly level with the upper surface of support members 30. By selecting this height for the blocks of insulation, a substantially continuous top surface over the top of the elongated support members and insulation blocks and/or panels is formed. As can be appreciated, the height of one or more blocks of insulation can be less than the height of the support members. As also illustrated in FIGS. 1-3, blocks of insulation 52 can be positioned in the cavity formed by the support members 30; however, this is not required. Typically the blocks of insulation 52 have a height that extends to the bottom surface of the support flange 40; however, it can be appreciated that the height can be lower. It can also be appreciated that no blocks of insulation can be positioned in the cavity formed by the support member.

A plurality of prefabricated roofing panels 60 are dimensioned to overlap the extended supporting members which define the extended predetermined lengths of each grid section of the supporting frame structure. A plurality of the roofing panels 60 are typically composed of a plurality of juxtaposed metal sheet sections 62; however, other or additional materials can be used. Each metal sheet section is typically joined with another metal sheet section by a watertight seal, not shown. Typically, the opposed edges of each metal sheet section that is to be joined are bent into a generally U-shaped bend. The bent edges of two metal sheet sections are typically joined together by a cleat, not shown. Each cleat includes reversely bent lips which are inserted between the bent edges. A layer of sealant is typically inserted in the crimped junction. The joined edge structure is then compressed to form a seal. This arrangement for connecting a plurality of metal sheet sections together to form a metal roofing panel 60 is well known in the art and will not be further described. As can be appreciated, one or more of the metal panels can be formed of a single sheet of metal material or some other type of material (e.g., fiber board, fiberglass-reinforced polymers (FRP) sheets, etc.). As can also be appreciated, the metal sections, when used, can be connected together in other ways to form a watertight seal in the roofing panel.

Roofing panel 60, when formed of a metal sheet material, is typically preformed from a continuous coil of sheet material, not shown, such as 30-gauge galvanized or 0.24 inch aluminum sheet; however, other types and/or thicknesses of metal can be used. These prefabricated roofing panels can be pre-painted; however, this is not required. The roofing panels 60 are typically about three to four feet wide; however, other widths can be used.

The coil of roofing panel is extended and cut into the individual roofing panels 60. The roofing panels can include corrugations 64 formed by running the individual panels through a pattern machine to apply corrugations; however, the corrugations, when formed, can be formed in other ways. The corrugations can serve to stiffen and strengthen the resulting roofing panels 60 and/or allow for expansion and/or contraction of the roofing panels without placing unnecessary stress on the structure which might otherwise cause the roofing system to lift or cause the roofing panels to tear away from the supporting structure members 30. The prefabrication of the roofing panels 60 can be accomplished away from the construction site, or the metal sheet sections can be at least partially connected together on site until the desired length of the roofing panels 60 is fabricated to a desired length.

When applying the roofing panels 60 on the support members 30, the roofing panels are generally freely disposed over the top surface of the insulation panels 50 without bonding thereto, when insulation blocks are used. The roofing panels 60 are typically only connected to the support members 30; however, it can be appreciated that one or more of the roofing panels can be secured to one or more blocks of insulation. When one or more of the roofing panels 60 are only connected to the support members 30, the roofing panels 60 are allowed to at least partially freely expand and contract between the support members 30 without placing unnecessary or undue stress on the supporting members 30, thereby reducing or avoiding damage to any sealed watertight integrity of the roofing system.

After the roofing panels 60 are positioned on the support members 30, the overlapping edges 66 of the roofing panels are secured to the underlying support members 30. When the roofing panels 60 are laid in place, the side edges 66 of two adjacently positioned roofing panels overlap one another. A liquid sealant or a sealant tape 70 is placed between the panel edges to create a primary sealed overlapping junction between adjacent roofing panels 60. As best illustrated in FIGS. 2 and 3, sealant tape 70 is partially positioned on the undersurface of the upper roofing panel and then bent about the edge of the upper roofing panel and then the remainder of the tape is secured to the top side of the upper roofing panel. The sealant tape 70 can be preformed on upper roofing panel 60 or be inserted on the roofing panel during the installation of the roofing system. As illustrated in FIG. 3, sealant tape is applied to and/or bent about the upper roofing panel prior to the upper roofing panel being finally positioned on top of a portion of the previously positioned bottom roofing panel 60. As can be appreciated, when the sealant tape is positioned on the upper roofing panel, the sealant tape has a generally C-shape cross-sectional shape. As illustrated in FIGS. 1 and 2, once the upper roofing panel is positioned on the bottom roofing panel such that the end edges of the top and bottom roofing panels overlap, sealant tape 70 forms a seal between the edges of the two overlapping roofing panels. Although it is shown in FIG. 1-3 that, the sealant tape is positioned on the upper roofing panel, it can be appreciated that the sealant tape can be instead be positioned on the bottom roofing panel. In such an arrangement, a seal is still formed between the edges of the two overlapping roofing panels once the upper roofing panel is positioned on the bottom roofing panel such that the end edges of the top and bottom roofing panels overlap. Additionally, the sealant tape can form a seal between the bottom roofing panel and the support member 30; however, this is not required. As can further be appreciated, a piece of sealant tape 70 can be placed on both the top and bottom panels; however, this is not required. Generally the seal formed by the sealant tape is a watertight seal; however, this is not required. The sealant tape, when used, can be a butyl sealant tape. One non-limiting butyl tape that can be used includes polyisobutylene tape. The sealant tape is typically a flexible tape that has a thickness of about 0.05-0.12 inch and a width of about 1-3 inches; however, other thicknesses and/or widths can be used.

As shown in FIGS. 1-3, a compression bar 80 is positioned over the top surface of the side edge 66 of the upper roofing panel 60 and is typically aligned along the edge 66 of the roofing panel such that the compression bar extends along an axis that is generally parallel to the longitudinal axis of the underlying support member 30. The compression bar has a body 82 and a lip 84 that is connected to or formed on one edge of body 82. Lip 84 can be used to facilitate in the alignment of the compression bar on the upper roofing panel; however, this is not required. As shown in FIGS. 1 and 2, the lip 84 of the compression bar 80 can be positioned along edge 66 of the upper roofing panel; thereby aligning the compression bar on the upper roofing panel.

Figure 4:
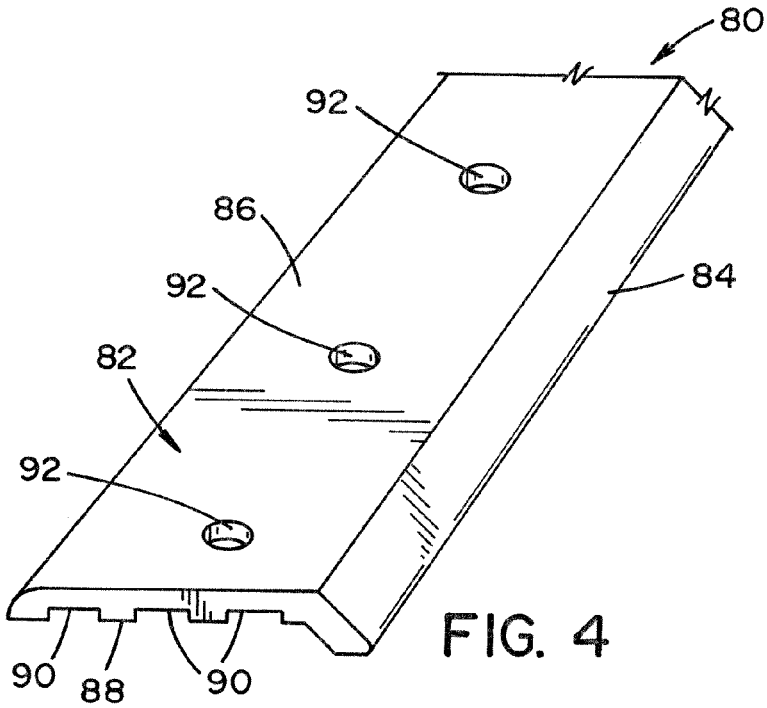
FIG. 4 is a perspective view of the compression bar of the present invention.
Figure 5:
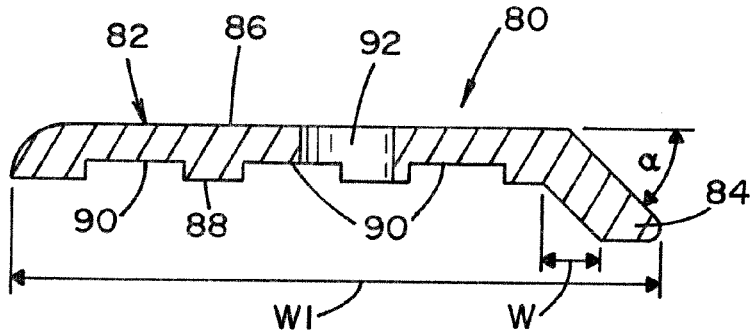
FIG. 5 is a cross-sectional view of the compression bar of FIG. 4.
Figure 6:
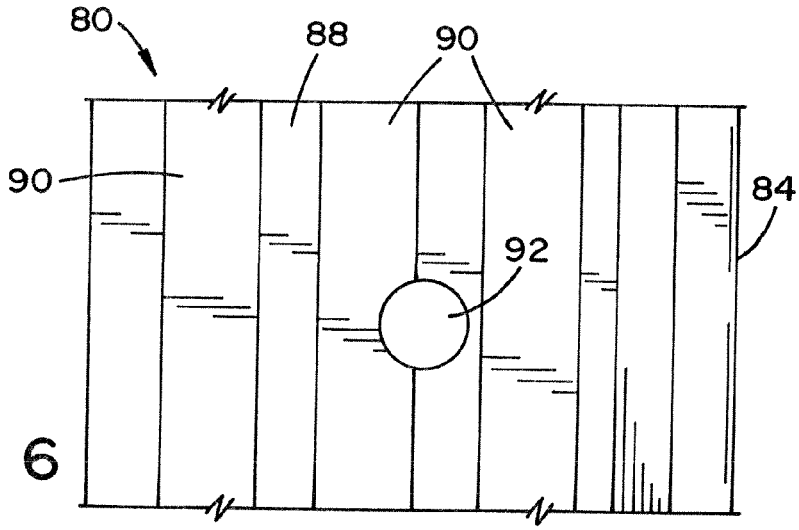
FIG. 6 is a bottom view of the compression bar of FIG. 4.

Referring now to FIGS. 4-6, the compression bar is typically a metal bar having a thickness of about 0.125-0.5 inch and a width of about 0.5-1.5 inches; however, the compression bar can be formed of other materials and/or have other dimensions. The body 82 of the compression bar typically has a generally flat top surface 86; however, it can be appreciated that the top surface can be other than a flat surface. The bottom surface 88 of the body of the compression bar has a non-smooth, non-flat and/or rough surface. This non-smooth, non-flat and/or rough surface is illustrated as being formed by a plurality of slots or notches 90; however, it can be appreciated that the non-smooth, non-flat and/or rough surface can be formed by other or additional configurations on the bottom surface of the body of the compression bar. As illustrated in FIGS. 4-6, slots or notches 90 run generally parallel to lip 84. Slots or notches 90 run generally along the full longitudinal length of the compression bar; however, this is not required. The non-smooth, non-flat and/or rough surface on the bottom surface 88 of the compression bar facilitates in compression bar gripping the top surface of the upper roofing panel 60 and/or gripping into a portion of sealant tape 70 as the compression bar is secured to the roofing system. As can be appreciated, non-smooth, non-flat and/or rough surface on the bottom surface 88 of the compression bar can provide other or addition advantages to the compression bar.

The compression bar 80 includes a plurality of fastener openings 92 that are spaced along the longitudinal axis of the compression bar. The openings generally have a circular shape and are generally the same size; however, this is not required. One or more of the fastener openings 90 can be pre-drilled in the compression bar; however, this is not required. The fastener openings are generally spaced at an equal distance apart; however, this is not required.

The lip 84 of the compression bar 80 is shown to be sloped at an angle $\alpha$ relative to the flat top surface 86 of the compression bar. Angle $\alpha$ is typically about 5-80°, and typically about 30-60°; however, other angles can be used. The lip 84 is illustrated as having a generally flat upper and lower surface; however, this is not required. Lip 84 is also illustrated as having a generally constant slope; however, this is not required. The width W of the lip 84 as compared to the total width W1 of the compression bar is typically about 10-30% of W1; however, other widths of the lip can be used.

The fastener openings are designed to function as a template for and to receive a fastener arrangement such as a self-tapping sheet metal screw 100. These screws are secured at spaced apart intervals, typically about 1.5-3 inches, along the entire overlapping length of the roofing panels. The screws are inserted through the fastener openings in the compression bar and penetrate the overlapping panel edges 66, the sealant tape 70, and the intermediate support flange 40 of the support members 30. The screws secure the overlapping edges 66 together and couple the roofing panels directly to the support member 30. The screws also draw the compression bar toward the support member and secure the compression bar to the upper roofing panel. As the compression bar 80 is drawn toward the support members 30, the compression bar 80 exerts a compressive force on the roofing panels 60 which in turn causes a compressive force to be exerted between the overlapping roofing panel edges 66 and sealant tape 70. As illustrated in FIG. 2, the compressing of the sealant tape 70 causes the bottom surface of the compression bar to bite into the sealant tape to create a seal (e.g., waterproof seal, etc.) between the compression tape, the top surface of the upper roofing panel and the bottom surface of the compression bar. In addition, the compression caused by the compression bar also causes a seal (e.g., waterproof seal, etc.) to be formed between the overlapping edges of the upper and bottom roofing panels. Furthermore, the compression of the sealant tape 70 also causes a portion of the sealant to flow toward to the lip of the compression bar, which at least partially fills in the gap between the bottom surface of the lip of the compression bar and the top surface of the upper roofing panel as illustrated in FIG. 2. The use of the compression bar 80 facilitates in applying a more uniform compressive force to the roofing panels 60 and sealant tape 70 during installation, thereby forming a higher quality seal between the roofing panels 60. The compression bar also inhibits or prevents the heads of the screws 90 from tearing into the roofing panels 60 due to overtorquing of the metal screws. The compression bar 80 further inhibits or prevents the roofing panels 60 from separating at the seal between the metal sections 62 when the metal screws 90 are securing the roofing panels 60 to the support members 30. The lip 84 on the compression bar 80 can facilitate in maintaining sealing tape 70 between the overlapping portions of roofing panels 60 when the compression bar 80 applies a compressive force to the roofing panels 60.

Screws 100 can be formed of a low heat conducting material or insulating material; however; this is not required. When screws 100 are formed of a low heat conducting material or insulating material, the heat transfer between the roofing panels 60 and the roof deck 20 is reduced, thus improving the insulating features of the roofing system.

A secondary sealant layer 110 can be at least partially applied over the compression bar 80 and fastener arrangement 100 as illustrated in FIG. 2 and/or the overlapping edges 66 of the roofing panels 60 to further increase the watertightness of the roofing system 10; however, this is not required. By applying a secondary sealant, the compression bar 80, the fastener arrangement 100 an or the overlapped edges 66 of the roofing panels 60 form an additional watertight seal around all or a portion of the periphery of each roofing panel 60. The secondary sealant 110 can be a liquid sealant, a sealing tape, etc.

Although not shown, the edges and/or sides of the building can be provided with flashing to at least partially seal the perimeter of the roofing system 10; however, this is not required. In addition, structures that extend upwardly from the roof deck 20 can also be at least partially sealed by the use of flashing; however, this is not required.

The roofing system 10 can be configured to create a pitched roof, rather than a substantially flat roof. The height of the support members 30 and the pitch of the intermediate support flange 40 can be selected to obtain the desired pitch of the roofing system.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

We claim:

1. A rooting system comprising:

a plurality of support members secured to a roof deck, a plurality of said support members spaced apart from one another, a plurality of said support members having a support flange spaced above said roof deck;

b) a plurality of blocks positioned between a plurality of said support members, a plurality of said blocks having a thickness such that a top surface of said blocks has a same height or a less height than a top surface of a plurality of said support flanges when said support members and said blocks are installed on said roof deck;

c) a plurality of rooting panels, each of said roofing panels includes a peripheral edge, said roofing panels positioned over a plurality of said blocks, a plurality of peripheral edges of adjacently positioned roofing panels overlapping one another;

d) a plurality of compression bars designed to compress together said overlapping peripheral edges of said roofing panels, a plurality of said compression bars positioned at least partially on top of said overlapping peripheral edges of said roofing panels, a plurality of said compression bars including a body and a lip along at least a portion of a longitudinal length of said body of said compression bars, said body prior to being secured to said roofing panels having two sides, a top surface and a bottom surface, said bottom surface having a plurality of gripping arrangements designed to enhance gripping features of said compression bars when said compression bars are secured to said roofing panels, said lip prior to being secured to said roofing panels angling downwardly from one of said sides of said body of said compression bars and an end of said lip extending below a bottom plane of said bottom surface of said body, a plurality of said compression bars secured to said roofing panels such that said bottom surface of said body is positioned over at least one of said roofing panels and said lip is positioned over at least a portion of one of said edges of said roofing panel; and, e) a plurality of connectors, said connectors include a top and body portion, said body portion of said connectors penetrating through said body of said compression bars and through said overlapping peripheral edges of said roofing panels and through said support flange of said support members, said plurality of said connectors causing a plurality of said compression bars to apply a substantially even compression force on said overlapping peripheral edges of said roofing panels.

2. The roofing system as defined in claim 1, wherein a plurality of said support members have a generally flat support flange.

3. The roofing system as defined in claim 1, wherein a plurality of said blocks positioned between a plurality of said support members are insulation blocks.

4. The roofing system as defined in claim 1, wherein a plurality of said roofing panels are substantially not bonded to a plurality of said blocks.

5. The roofing system as defined in claim 1, wherein a plurality of said compression bars have only one lip along at least a portion of a longitudinal length of said body of said compression bars.

6. The rooting system as defined in claim 1, wherein a plurality of said compression bars have a plurality of openings along a longitudinal length of said compression bars.

7. The roofing system as defined in claim 1, wherein said gripping arrangement on said bottom surface of a plurality of said compression bars includes a plurality of teeth, grooves, bumps, ribs, slots, notches, channels, corrugations, and combinations thereof.

8. The roofing system as defined in claim 1, including a sealant positioned between a plurality of said overlapping peripheral edges of said roofing panels, said sealant forming a watertight seal between said overlapping peripheral edges.

9. The roofing system as defined in claim 1, including a sealant positioned between said bottom surface of at least one of said compression bars and at least one of said roofing panels when said compression bar is secured to said roofing panel, said sealant forming a watertight seal between said compression bar and said roofing panel.

10. The roofing system as defined in claim 8, including a sealant positioned between said bottom surface of at least one of said compression bars and at least one of said roofing panels when said compression bar is secured to said roofing panel, said sealant forming a watertight seal between said compression bar and said roofing panel.

11. The roofing system as defined in claim 10, wherein said sealant includes a tape sealant, a single piece of said sealant tape is positioned both between a plurality of said overlapping peripheral edges of said roofing panels and between said bottom surface of at least one of said compression bars and at least one of said roofing panels when said compression bar is secured to said roof panels.

12. The roofing system as defined in claim 11, wherein said tape sealant includes butyl tape.

13. The roofing system as defined in claim 1, wherein said body and said lip of a plurality of said compression bars has a thickness that is greater than each of said roofing panels.

14. The roofing system as defined in claim 11, including a secondary sealing material over a plurality of said compression bars.

15. The roofing system as defined in claim 1, wherein a secondary block of insulation is positioned under said support flange of at least one of said support members.

16. The roofing system as defined in claim 1, wherein said body of a plurality of said compression bars have a generally flat and planar top surface prior to being secured to said roofing panels.

17. The roofing system as defined in claim 1, wherein said body of a plurality of said compression bars includes at least three openings, said at least three openings in said compression bars are preformed openings, at least three of said openings being spaced apart generally at a same distance from one another.

18. The roofing system as defined in claim 16, wherein a plurality of said compression bars have only one lip along at least a portion of a longitudinal length of said body of said compression bars, a plurality of said compression bars have a plurality of openings along a longitudinal length of said compression bars, said gripping arrangement includes a plurality of slots or notches along a longitudinal length of said body, said gripping arrangement includes a continuous row of slots or notches along a longitudinal length of said body.

19. A compression bar having body and a single lip, said compression bar adapted to at least partially compress together overlapping edges of a plurality roofing panels, said body having two sides, and bottom and top surfaces, said single lip positioned on only one of said sides of said body and along at least a portion of a longitudinal length of said body, said bottom surface having a plurality of gripping arrangements designed to enhance gripping features of said compression bar when said compression bar is secured to the roofing panel, said lip angling downwardly from said side of said body such that a front end of said lip is positioned below a bottom plane of said body prior to being connected to the roof panel, said longitudinal length of said body substantially greater than a width of said body, said body having a thickness that is substantially less than a width of said body, said body having a width that is greater than said lip.

20. The compression bar as defined in claim 19, wherein said gripping arrangement on said bottom surface of a plurality of said compression bar includes a plurality of teeth, grooves, bumps, ribs, slots, notches, channels, corrugations, and combinations thereof.

21. The compression bar as defined in claim 19, wherein said body includes at least three openings that are spaced at equal distances from one another along the longitudinal length of said body.

22. The compression bar as defined in claim 19, wherein said body has a top surface that is substantially flat and planar.

23. The compression bar as defined in claim 19, wherein lip has a width that is about 10-30% the total width of said compression bar.

24. The compression bar as defined in claim 19, wherein said longitudinal length of said body is at least about 400% greater than said width of said body.

25. The compression bar as defined in claim 19, wherein said thickness of said body is at least about 50% less than said width of said body.

26. A method of installing a roofing system on a roofing deck comprising:

a) providing a plurality of support members, said support members having a support flange spaced above said roof deck;

b) securing said plurality of support members to the roofing deck, a plurality of said support members spaced apart from one another;

c) providing a plurality of blocks;

d) positioning a plurality of said blocks between a plurality of said support members, a plurality of said blocks having a thickness such that a top surface of said blocks has a same height or a less height than a top surface of a plurality of said support flanges when said support members and blocks are installed on said roof deck;

e) providing a plurality of roofing panels, each of said roofing panels includes a peripheral edge;

f) positioning said roofing panels over a plurality of said blocks and a plurality of support members, a plurality of said peripheral edges of adjacently positioned roofing panels overlapping one another, at least a portion of at least said peripheral edges of a plurality adjacently positioned roofing panels positioned over said support flange of at least one of said support members;

g) providing a plurality of compression bars, each of said compression bars including a body and a lip positioned along at least a portion of a longitudinal length of said body of said compression bar, said body having two sides and a top and bottom surface, said bottom surface having a plurality of gripping arrangements designed to enhance gripping features of said compression bars when said compression bars are secured to said roofing panel, said lip angling downwardly from one of said sides of said body of said compression bars and an end of said lip extending below a bottom plane of said bottom surface of said body;

h) positioning a plurality of said compression bars over at least a portion of said overlapping peripheral edges such that said bottom surface of said body of said compression bars are positioned over at least one of said roofing panels and said lip of said compression bars are positioned over at least one edge of said roofing panel;

i) providing a plurality of connectors, each of said connectors including a top and body portion; and, j) inserting said body portion of a plurality of said connectors through said body of said compression bars and through said overlapping peripheral edges of said roofing panels and through said through said support flange of said support members so as to secure together said compression bars, said overlapping roofing panels and said support members, and to also cause said compression bars to compress together said overlapping peripheral edges of said roofing panels.

27. The method as defined in claim 26, wherein a plurality of said support members have a generally flat support flange.

28. The method as defined in claim 26, wherein a plurality of said blocks are insulation blocks.

29. The method as defined in claim 26, wherein a plurality of said roofing panels are substantially not bonded to a plurality of said blocks.

30. The method as defined in claim 26, wherein a plurality of said compression bars have only one lip along at least a portion of a longitudinal length of said body of said compression bars.

31. The method as defined in claim 26, wherein a plurality of said compression bars have a plurality of openings along a longitudinal length of said compression bars.

32. The method as defined in claim 31, wherein said openings along said longitudinal length of said body of a plurality of said compression bars are preformed openings.

33. The method as defined in claim 26, wherein said gripping arrangement on said bottom surface of a plurality of said compression bars includes a plurality of teeth, grooves, bumps, ribs, slots, notches, channels, corrugations, and combinations thereof.

34. The method as defined in claim 26, including the steps of providing a sealant and applying at least a portion of said sealant between a plurality of said overlapping peripheral edges of said roofing panels to form a watertight seal between said overlapping peripheral edges.

35. The method as defined in claim 26, including the steps of providing a sealant and applying at least a portion of said sealant between at least one of said compression bars and at least one of said roofing panels to form a watertight seal between said compression bar and said roofing panel.

36. The method as defined in claim 34, including the step of applying at least a portion of said sealant between at least one of said compression bars and at least one of said roofing panels to form a watertight seal between said compression bar and said roofing panel.

37. The method as defined in claim 36, wherein said step of inserting said body portion of a plurality of said connectors causes said compression bars to apply a substantially even compression force on said sealant positioned between said compression bars and said roofing panel and between a plurality of said overlapping peripheral edges of said roofing panels.

38. The method as defined in claim 35, wherein said sealant includes a single tape sealant.

39. The method as defined in claim 37, wherein said sealant includes a single tape sealant.

40. The method as defined in claim 39, wherein said tape sealant including butyl tape.

41. The method as defined in claim 26, including the step of inserting a secondary block of insulation under said support flange of at least one of said support members.

42. The method as defined in claim 26, including the steps of providing a sealant and applying the sealant at least partially on a top surface of said compression bars.

43. The method as defined in claim 26, including the steps of providing a sealant and applying said sealant at least partially between said at least one support member and at least one of said rooting panels.

44. The roofing system as defined in claim 7, wherein said gripping arrangement includes a plurality of slots or notches along a longitudinal length of said body.

45. The roofing system as defined in claim 44, wherein said gripping arrangement includes a continuous row of slots or notches along a longitudinal length of said body.

46. The roofing system as defined in claim 44, wherein said gripping arrangement includes a plurality of rows of slots or notches along a longitudinal length of said body.

47. The compression bar as defined in claim 20, wherein said gripping arrangement includes a plurality of slots or notches along a longitudinal length of said body.

48. The compression bar as defined in claim 47, wherein said gripping arrangement includes a continuous row of slots or notches along a longitudinal length of said body.

49. The compression bar as defined in claim 47, wherein said gripping arrangement includes a plurality of rows of slots or notches along a longitudinal length of said body.

50. The compression bar as defined in claim 19, wherein said body has a plurality of openings along a longitudinal length of said compression bar, said body has a top surface that is substantially flat and planar, said gripping arrangement includes a plurality of slots or notches along a longitudinal length of said body, said ripping arrangement includes a continuous row of slots or notches along a longitudinal length of said body.

51. The method as defined in claim 33, wherein said gripping arrangement includes a plurality of slots or notches along a longitudinal length of said body.

52. The method as defined in claim 51, wherein said gripping arrangement includes a continuous row of slots or notches along a longitudinal length of said body.

53. The method as defined in claim 51, wherein said gripping arrangement includes a plurality of rows of slots or notches along a longitudinal length of said body.

54. The method as defined in claim 26, wherein a plurality of said compression bars have only one lip along at least a portion of a longitudinal length of said body of said compression bars, said body of a plurality of said compression bars have a generally flat and planar top surface prior to being secured to said roofing panels, a plurality of said compression bars have a plurality of openings along a longitudinal length of said compression bars, said gripping arrangement includes a plurality of slots or notches along a longitudinal length of said body, said gripping arrangement includes a continuous row of slots or notches along a longitudinal length of said body.

* * * * *